US011576421B2

(12) United States Patent
Zhang et al.

(10) Patent No.: US 11,576,421 B2
(45) Date of Patent: Feb. 14, 2023

(54) METHOD FOR INCREASING BULKINESS OF RECONSTITUTED TOBACCO

(71) Applicants: Meiyun Zhang, Xi'an (CN); Shunxi Song, Xi'an (CN); Xue Jiang, Xi'an (CN); Bin Yang, Xi'an (CN); Jingyi Nie, Xi'an (CN); Jiaojun Tan, Xi'an (CN)

(72) Inventors: Meiyun Zhang, Xi'an (CN); Shunxi Song, Xi'an (CN); Xue Jiang, Xi'an (CN); Bin Yang, Xi'an (CN); Jingyi Nie, Xi'an (CN); Jiaojun Tan, Xi'an (CN)

(73) Assignee: SHAANXI UNIVERSITY OF SCIENCE AND TECHNOLOGY, Shaanxi (CN)

( * ) Notice: Subject to any disclaimer, the term of this patent is extended or adjusted under 35 U.S.C. 154(b) by 351 days.

(21) Appl. No.: 17/037,552

(22) Filed: Sep. 29, 2020

(65) Prior Publication Data

US 2021/0259297 A1 Aug. 26, 2021

(30) Foreign Application Priority Data

Feb. 20, 2020 (CN) ..... 202010104973.5

(51) Int. Cl.

| | |
|---|---|
| ***A24B 3/14*** | (2006.01) |
| ***A24B 15/12*** | (2006.01) |
| ***A24B 15/24*** | (2006.01) |
| ***A24B 3/18*** | (2006.01) |
| *A24B 15/28* | (2006.01) |

(52) U.S. Cl.

CPC ..... *A24B 3/14* (2013.01); *A24B 3/18* (2013.01); *A24B 15/12* (2013.01); *A24B 15/24* (2013.01); *A24B 15/285* (2013.01); *A24B 15/287* (2013.01)

(58) Field of Classification Search

CPC .. A24B 3/14; A24B 3/18; A24B 15/12; A24B 15/24; A24B 15/287; A24B 15/385

See application file for complete search history.

(56) References Cited

FOREIGN PATENT DOCUMENTS

| | | | | |
|---|---|---|---|---|
| CN | 103211286 A | | 7/2013 | |
| CN | 106418651 | * | 2/2017 | ..... A24B 3/14 |
| CN | 106993820 A | | 8/2017 | |

OTHER PUBLICATIONS

CN106418651A—Original (Year: 2017).*

* cited by examiner

*Primary Examiner* — Michael J Felton
*Assistant Examiner* — Ronnie Kirby Jordan

(57) ABSTRACT

A method for increasing bulkiness of reconstituted tobacco by adding tobacco stem particles includes (1) pulverizing a first portion of tobacco stems to obtain tobacco stem particles; (2) classifying the tobacco stem particles with mesh sieves and selecting the tobacco stem particles with a predetermined mesh size; (3) extracting a second portion of the tobacco stems with water and grinding to form a tobacco stem slurry that has a beating degree of 12-14° SR, and mixing the tobacco stem slurry with tobacco leaves in a weight ratio of 6:4 and grinding to obtaining a tobacco slurry that has a beating degree of 18-20° SR; (4) cutting plant fiber pulp boards and dispersing in water to form a plant fiber pulp; (5) preparing a filler solution that contains 10 wt % of a mineral filler; (6) mixing, rolling and drying to obtain the reconstituted tobacco.

6 Claims, 5 Drawing Sheets

METHOD FOR INCREASING BULKINESS OF RECONSTITUTED TOBACCO

The present invention claims priority to Chinese Patent Application No. 202010104973.5, filed on Feb. 20, 2020.

FIELD OF THE INVENTION

The present invention relates to the field of reconstituted tobacco, in particular a method for increasing the bulkiness of reconstituted tobacco.

BACKGROUND OF THE INVENTION

Reconstituted tobacco, also known as tobacco flakes, is produced by using tobacco stems, broken leaves, tobacco dust and other leftovers produced during the production process of cigarettes. Its performance is similar to that of natural tobacco, and it is mixed and used with natural tobacco. Reconstituted tobacco is an important raw material in modern tobacco manufacturing. With the development of the tobacco industry, it is found that adding appropriate amounts of reconstituted tobacco to cigarettes can not only increase the utilization rate of tobacco raw materials and increase the economic benefits of the cigarette industry, but also improve the physical properties of cigarettes, such as filling value, burning speed, etc. Reconstituted tobacco can also reduce the harmful ingredients in tobacco, such as tar and nicotine, which is of great significance to improve the quality of cigarettes.

Bulkiness is one of the important technical indicators for evaluating the quality of reconstituted tobacco. It directly affects the liquid absorption of the reconstituted tobacco during dip coating and the release of harmful components from the reconstituted tobacco. A high bulkiness can improve the filling properties of reconstituted tobacco in cigarettes and the burning performance of cigarettes and can reduce the release of harmful substances, such as carbon monoxide.

Chinese patent application publication number CN 103211286 A discloses a method for increasing the bulkiness of reconstituted tobacco by using sodium bicarbonate as a pretreatment method. Chemical reagents, such as acetic acid and sodium bicarbonate, are added. During the drying process, with the decomposition of sodium bicarbonate, gas is generated to increase the bulkiness of the reconstituted tobacco. However, sodium bicarbonate will further aggravate the difficulties of sewage treatment and at the same time have a negative impact on the quality of cigarettes. Chinese patent application publication number CN106993820A discloses a method for optimizing fiber types and ratios to increase the thickness of the base bulk of reconstituted tobacco leaves, but this method limits the types and amounts of added plant fibers, which is not conducive to the adjustment of the actual production of the factory. In recent years, the price of bleached softwood and hardwood has risen sharply, and the profit margin of manufacturers has been continuously compressed. To reduce the cost of use and improve the bulkiness of the reconstituted tobacco is a key issue faced by reconstituted tobacco manufacturers.

SUMMARY OF THE INVENTION

In one embodiment, a method for increasing bulkiness of reconstituted tobacco by adding tobacco stem particles includes the following steps: (1) pulverizing a first portion of tobacco stems to obtain tobacco stem particles; (2) classifying the tobacco stem particles with mesh sieves and selecting the tobacco stem particles with a predetermined mesh size; (3) extracting a second portion of the tobacco stems with water and grinding to form a tobacco stem slurry that has a beating degree of 12-14° SR (Schopper Riegler Degree), and mixing the tobacco stem slurry with tobacco leaves in a weight ratio of 6:4 and grinding to obtaining a tobacco slurry that has a beating degree of 18-20° SR; (4) cutting plant fiber pulp boards and dispersing in water to form a plant fiber pulp; (5) preparing a filler solution that contains 10 wt % of a mineral filler; and (6) mixing the tobacco stem particles with the predetermined mesh size, the tobacco slurry, the plant fiber pulp, and the filler solution, rolling and drying to obtain the reconstituted tobacco with increased bulkiness.

In another embodiment, in step (2), the mesh sieves have mesh sizes of 60, 80, 120, and 200 mesh.

In another embodiment, in step (2), the tobacco stem particles with the predetermined mesh size include one or more selected from the group consisting of tobacco stem particles A with a particle size of greater than 250 μm, tobacco stem particles B with a particle size of between 180 μm and 250 μm, tobacco stem particles C with a particle size of between 120 μm and 180 μm, and tobacco stem particles D with a particle size of between 75 μm and 120 μm; the tobacco stem particles B increase the bulkiness and an air permeability of the reconstituted tobacco; the tobacco stem particles C increase the bulkiness of the reconstituted tobacco; the tobacco stem particles D increase the bulkiness and a strength of the reconstituted tobacco; and a combination of the tobacco stem particles A and the tobacco stem particles B increases bulkiness and a softness of the reconstituted tobacco.

In another embodiment, the plant fiber pulp boards are bleached softwood pulp boards, bleached hardwood pulp boards, or natural insulating pulp boards.

In another embodiment, the mineral filler is a calcium carbonate filler with an average particle size of 4-10 μm or a porous calcium silicate filler with an average particle size of 15-40 μm.

In another embodiment, a dry weight ratio of the second tobacco slurry, the plant fiber pulp, and the mineral filler is 1:0.25:0.15; and the tobacco stem particles with the predetermined mesh size is about 15 wt % of a total dry weight of the second tobacco slurry and the plant fiber pulp.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
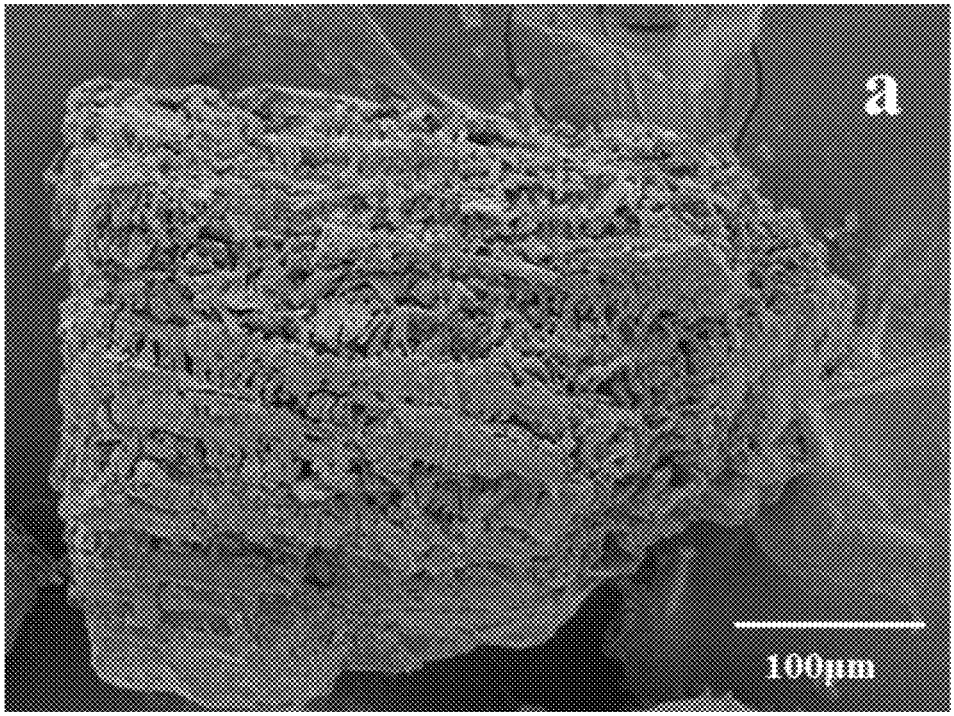
FIG. 1 is the scanning electron microscope (SEM) image of the tobacco stem particles A.

Reference will now be made in detail to embodiments of the present invention, example of which is illustrated in the accompanying drawings.

The invention discloses a method for preparing reconstituted tobacco with increased bulkiness through a simple method. The method of the present invention is simple and feasible, easy to realize industrialized production, and can effectively improve the bulkiness, air permeability, softness, and combustion performance of the reconstituted tobacco and reduce CO emissions, and ultimately improve the quality of reconstituted tobacco products by optimizing the particle size of tobacco stem particles.

Because the tobacco stem particles of different sizes have different effects on the performance of the reconstituted tobacco, the stem particles are directly to the slurry without sieving to the slurry, which helps to improve the performance of the reconstituted tobacco. In addition, since the cost of tobacco stems is lower than that of external fibers, the present invention is also beneficial to reduce the production cost of the reconstituted tobacco.

Specifically, the methods of the present invention include the following steps:

(1) Pulverize tobacco stems to obtain tobacco stem particles by using a pulverizer.

(2) The stem particles are classified through mesh sieves of different meshes to obtain stem particle powders of different mesh sizes. Four kinds of mesh sieves are used, and the mesh sizes are 60, 80, 120, and 200 meshes. Four tobacco stem particles of different particle sizes are obtained: tobacco stem particles A, >250 μm; tobacco stem particles B, >180 μm and <250 μm; tobacco stem particles C, >120 μm and <180 μm; and tobacco stem particles D, >75 μm and <120 μm. the tobacco stem particles B increase the bulkiness and an air permeability of the reconstituted tobacco; the tobacco stem particles C increase the bulkiness of the reconstituted tobacco; the tobacco stem particles D increase the bulkiness and a strength of the reconstituted tobacco; and a combination of the tobacco stem particles A and the tobacco stem particles B increases bulkiness and a softness of the reconstituted tobacco.

(3) Additional tobacco stems are extracted with water, and grinded to obtain a tobacco stem slurry with a beating degree of 12-14° SR (Schopper Riegler Degree). The tobacco stem slurry is mixed with tobacco leaves in a weight ratio of 6:4, and grinded to obtain a tobacco slurry is obtained with a beating degree of 18-20° SR.

(4) Plant fiber pulp boards are cut and dispersed in water to form a plant fiber pulp by a disintegrator.

(5) The mineral filler is dissolved in water to form a filler solution with a concentration of 10 wt %.

(6) The tobacco stem particles, the tobacco slurry, the plant fiber pulp, and the filler solution are mixed, rolled and dried to form reconstituted tobacco with increased bulkiness.

The plant fiber pulp boards can be bleached softwood pulp boards, bleached hardwood pulp boards, or natural insulating pulp boards. The bleached softwood pulp boards are preferably the Canadian Rainbow Fish brand or the Russian Wuzhen brand bleached softwood pulp boards. The bleached hardwood pulp boards are preferably the Canadian Prince George brand and the Chilean Star brand. The mineral filler is a calcium carbonate filler with a partial triangular shape, with an average particle size of 4-10 μm, preferably an average particle size of 8-10 μm; or a porous calcium silicate filler with an average particle size of 15-40 μm, preferably an average particle size of 18-25 μm. In the mixture, the dry weight ratio of tobacco slurry, additional plant fiber, and filler is 1:0.25:0.15, and the added amount of stem particle particles is 15% of the total dry weight of tobacco slurry and the plant fiber pulp.

Example 1

(1) Tobacco stems were grinded to tobacco stem particles using a pulverizer. The tobacco stem particles were passed through mesh sieves of 60, 80, 120, and 200 meshes to obtain tobacco stem particles A, tobacco stem particles B, tobacco stem particles C, and tobacco stem particles D.

(2) Additional tobacco stems were extracted with water and grinded to obtain a tobacco stem slurry with a beating degree of 12° SR. The tobacco stem slurry and tobacco leaves were mixed in a weight ratio of 6:4 and grinded to form a tobacco slurry with a beating degree of 18° SR.

(3) Canadian Rainbow Fish brand bleached softwood pulp boards were cut and dispersed in water by a disintegrator to form a plant fiber pulp.

(4) Calcium carbonate filler with partial triangular shape and a particle size of 8-10 μm was dissolved in water to form a 10 wt % filler solution.

Figure 2:
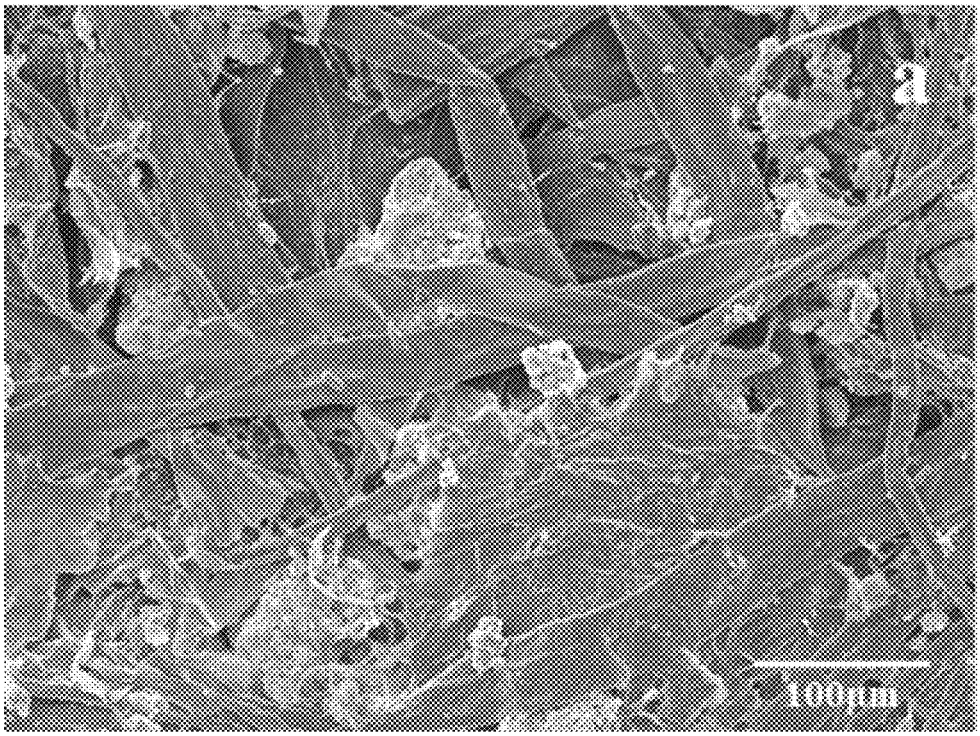
FIG. 2 is the SEM image of the reconstituted tobacco of Example 1.

(5) The tobacco slurry, the plant fiber pulp, and filler were mixed in a dry weight ratio of 1:0.25:0.15. The tobacco stem particles A were added in an amount of 15 wt % of the total dry weight of the tobacco slurry and the plant fiber pulp to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 1. FIG. 1 is the scanning electron microscope (SEM) image of the tobacco stem particles A. FIG. 2 is the SEM image of the reconstituted tobacco of Example 1.

Example 2

(1) Tobacco stems were grinded to tobacco stem particles using a pulverizer. The tobacco stem particles were passed through mesh sieves of 60, 80, 120, and 200 meshes to obtain tobacco stem particles A, tobacco stem particles B, tobacco stem particles C, and tobacco stem particles D.

(2) Additional tobacco stems were extracted with water and grinded to obtain a tobacco stem slurry with a beating degree of 12° SR. The tobacco stem slurry and tobacco leaves were mixed in a weight ratio of 6:4 and grinded to form a tobacco slurry with a beating degree of 18° SR.

(3) The Russian Wuzhen brand bleached softwood pulp boards were cut and dispersed in water by a disintegrator to form a plant fiber pulp.

(4) Calcium carbonate filler with partial triangular shape and a particle size of 8-10 μm was dissolved in water to form a 10 wt % filler solution.

Figure 3:
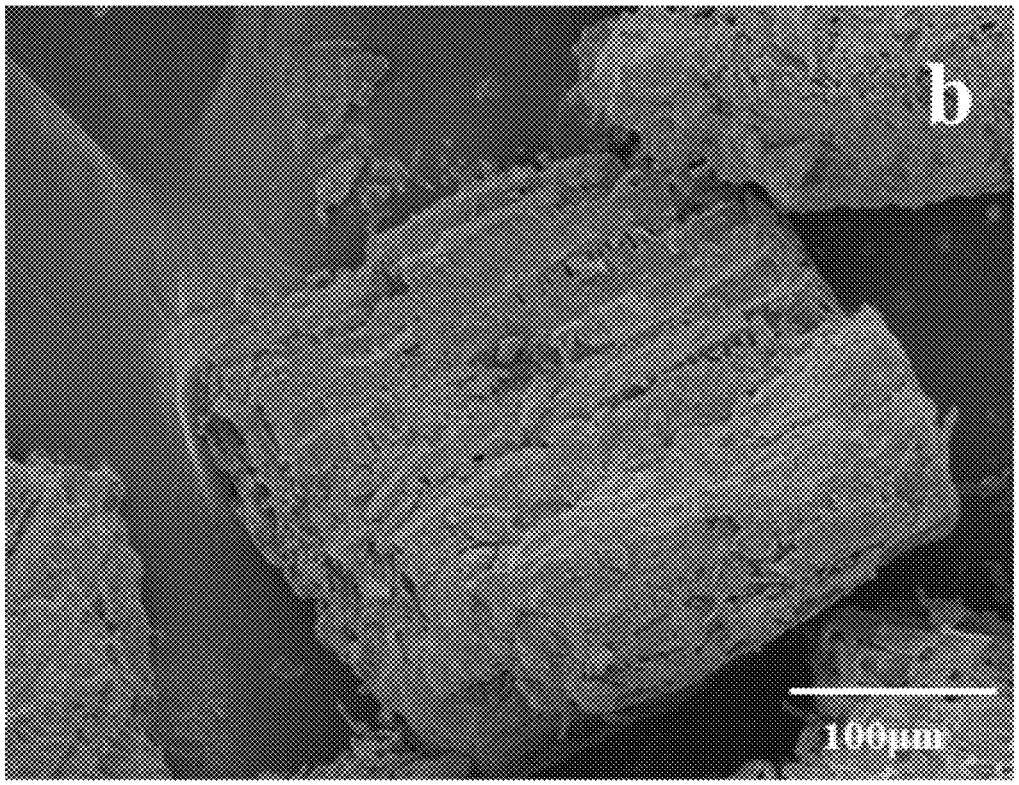
FIG. 3 is the SEM image of the tobacco stem particles B.
Figure 4:
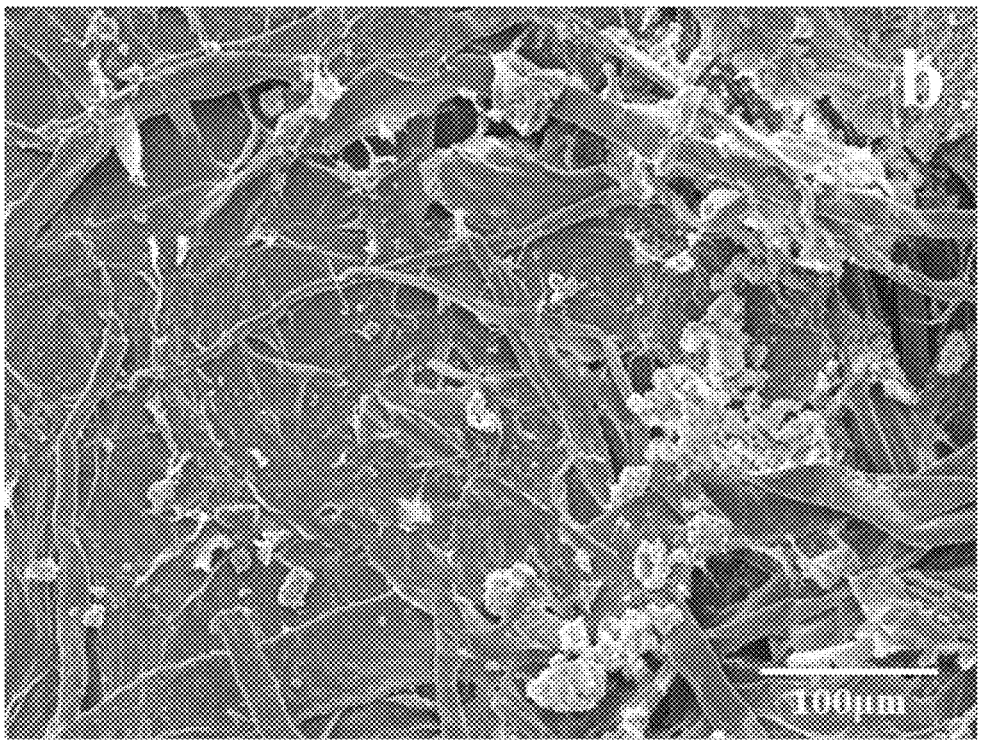
FIG. 4 is the SEM image of the reconstituted tobacco of Example 2.

(5) The tobacco slurry, the plant fiber pulp, and filler were mixed in a dry weight ratio of 1:0.25:0.15. The tobacco stem particles B were added in an amount of 15 wt % of the total dry weight of the tobacco slurry and the plant fiber pulp to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 1. FIG. 3 is the scanning electron microscope (SEM) image of the tobacco stem particles A. FIG. 4 is the SEM image of the reconstituted tobacco of Example 2.

Example 3

(1) Tobacco stems were grinded to tobacco stem particles using a pulverizer. The tobacco stem particles were passed through mesh sieves of 60, 80, 120, and 200 meshes to obtain tobacco stem particles A, tobacco stem particles B, tobacco stem particles C, and tobacco stem particles D.

(2) Additional tobacco stems were extracted with water and grinded to obtain a tobacco stem slurry with a beating degree of 13° SR. The tobacco stem slurry and tobacco leaves were mixed in a weight ratio of 6:4 and grinded to form a tobacco slurry with a beating degree of 20° SR.

(3) The Canadian Rainbow Fish brand bleached softwood pulp boards were cut and dispersed in water by a disintegrator to form a plant fiber pulp.

(4) Calcium carbonate filler with partial triangular shape and a particle size of 8-10 μm was dissolved in water to form a 10 wt % filler solution.

Figure 5:
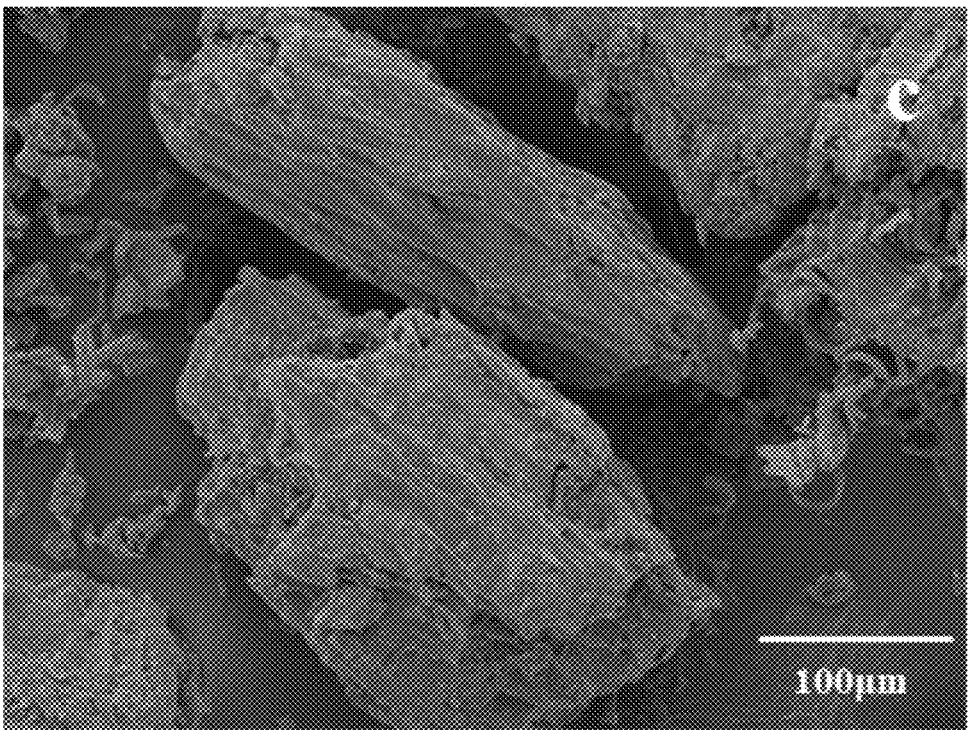
FIG. 5 is the SEM image of the tobacco stem particles C.
Figure 6:
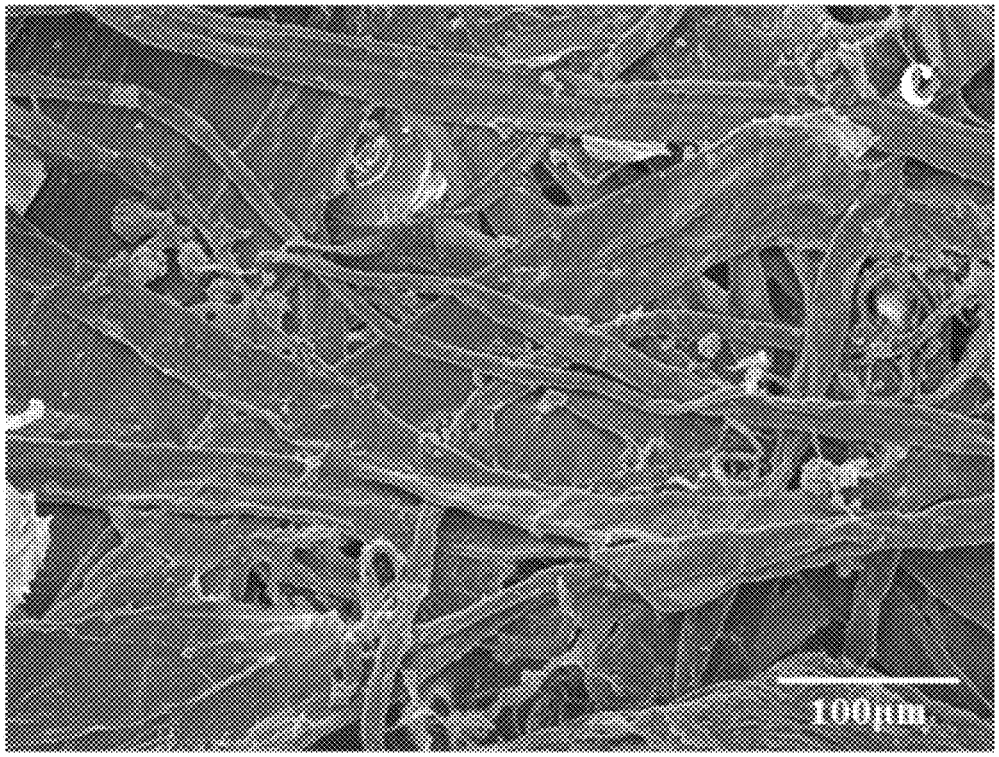
FIG. 6 is the SEM image of the reconstituted tobacco of Example 3.

(5) The tobacco slurry, the plant fiber pulp, and filler were mixed in a dry weight ratio of 1:0.25:0.15. The tobacco stem particles C were added in an amount of 15 wt % of the total dry weight of the tobacco slurry and the plant fiber pulp to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 1. FIG. 5 is the scanning electron microscope (SEM) image of the tobacco stem particles A. FIG. 6 is the SEM image of the reconstituted tobacco of Example 3.

Example 4

(1) Tobacco stems were grinded to tobacco stem particles using a pulverizer. The tobacco stem particles were passed through mesh sieves of 60, 80, 120, and 200 meshes to obtain tobacco stem particles A, tobacco stem particles B, tobacco stem particles C, and tobacco stem particles D.

(2) Additional tobacco stems were extracted with water and grinded to obtain a tobacco stem slurry with a beating degree of 13° SR. The tobacco stem slurry and tobacco leaves were mixed in a weight ratio of 6:4 and grinded to form a tobacco slurry with a beating degree of 20° SR.

(3) The Canadian Rainbow Fish brand bleached softwood pulp boards were cut and dispersed in water by a disintegrator to form a plant fiber pulp.

(4) Calcium carbonate filler with partial triangular shape and a particle size of 8-10 μm was dissolved in water to form a 10 wt % filler solution.

Figure 7:
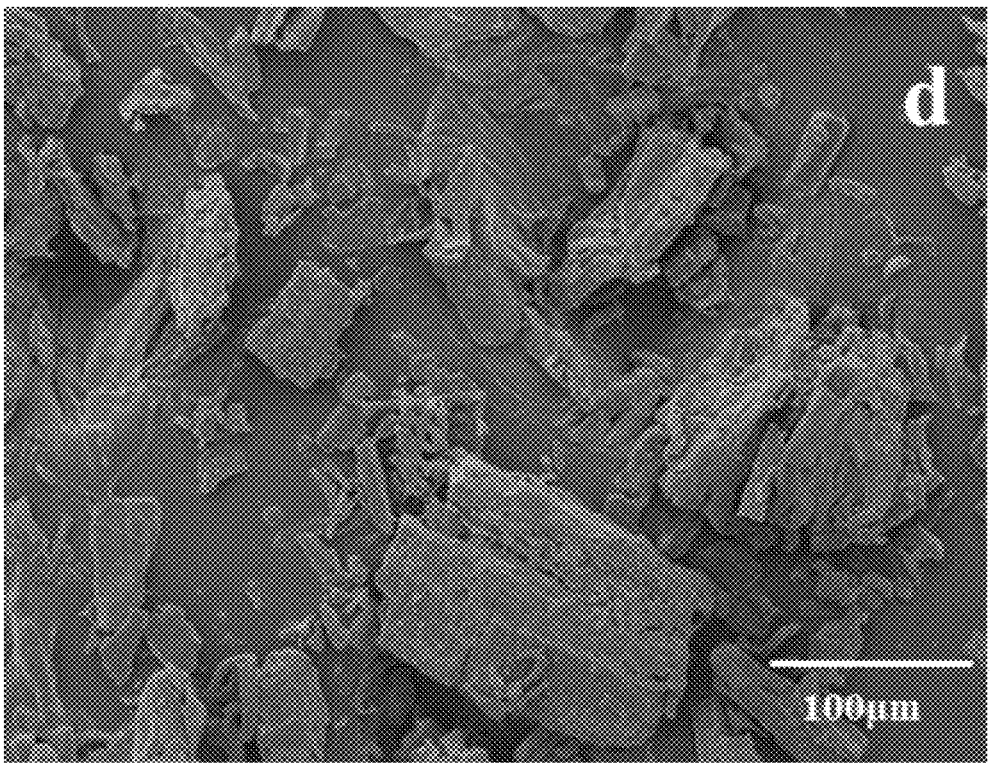
FIG. 7 is the SEM image of the tobacco stem particles D.
Figure 8:
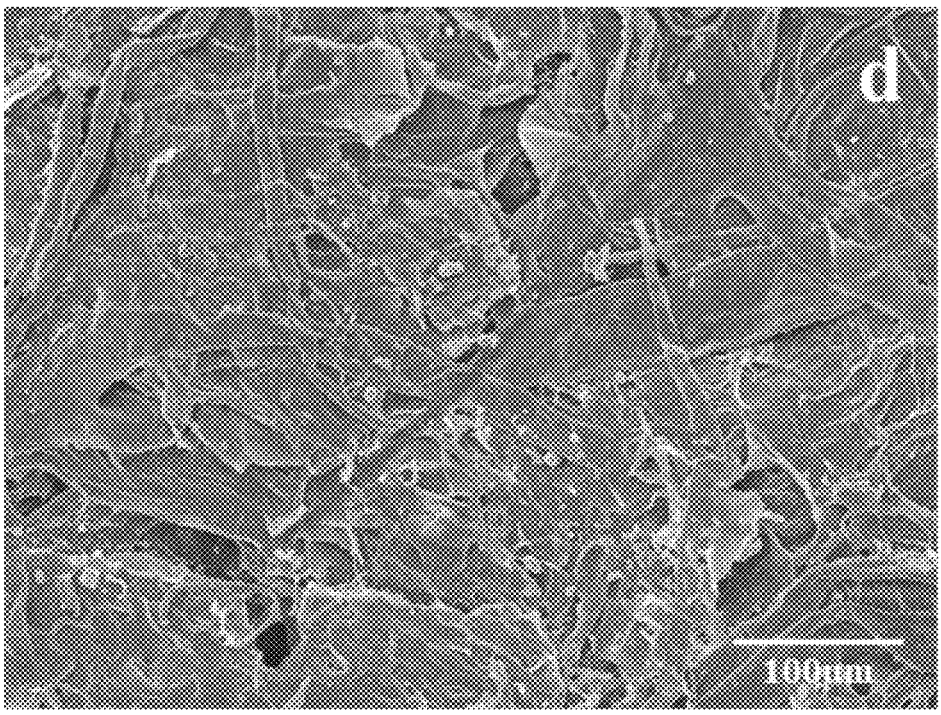
FIG. 8 is the SEM image of the reconstituted tobacco of Example 4.

(5) The tobacco slurry, the plant fiber pulp, and filler were mixed in a dry weight ratio of 1:0.25:0.15. The tobacco stem particles D were added in an amount of 15 wt % of the total dry weight of the tobacco slurry and the plant fiber pulp to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 1. FIG. 7 is the scanning electron microscope (SEM) image of the tobacco stem particles A. FIG. 8 is the SEM image of the reconstituted tobacco of Example 4.

Example: Control 1

(1) Tobacco stems were extracted with water and grinded to obtain a tobacco stem slurry with a beating degree of 12° SR. The tobacco stem slurry and tobacco leaves were mixed in a weight ratio of 6:4 and grinded to form a tobacco slurry with a beating degree of 19° SR.

(2) The Canadian Rainbow Fish brand bleached softwood pulp boards were cut and dispersed in water by a disintegrator to form a plant fiber pulp.

(3) Calcium carbonate filler with partial triangular shape and a particle size of 8-10 μm was dissolved in water to form a 10 wt % filler solution.

Figure 9:
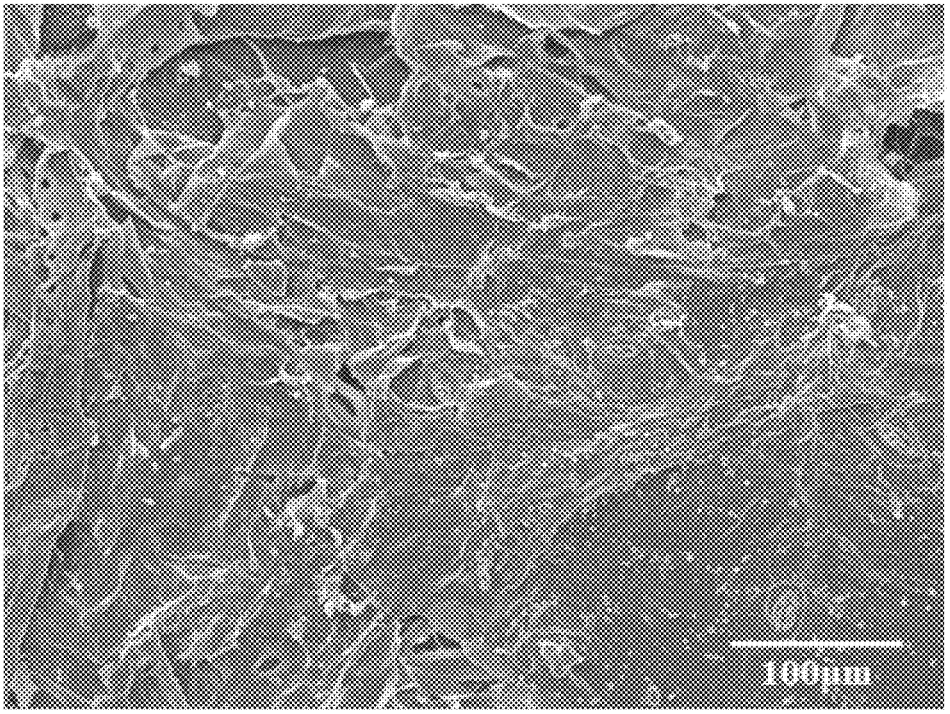
FIG. 9 is the SEM image of the reconstituted tobacco of Control 1.

(4) The tobacco slurry, the plant fiber pulp, and filler were mixed in a dry weight ratio of 1:0.25:0.15 to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 1. FIG. 9 is the SEM image of the reconstituted tobacco of Example Control 1.

TABLE 1

Reconstituted Tobacco of Examples 1-4

| | Control 1 | Example 1 | Example 2 | Example 3 | Example 4 |
|---|---|---|---|---|---|
| Tobacco Stem Particles | n/a | A | B | C | D |
| Bulkiness (cm$^3$/g) | 3.01 | 3.26 | 3.20 | 3.19 | 3.10 |
| Tensile Strength (N) | 6.0 | 4.9 | 5.0 | 5.1 | 5.6 |
| Air Permeability (um/Pa·s) | 61.4 | 74.0 | 87.0 | 80.4 | 71.2 |
| Softness (mN) | 466 | 430 | 442 | 506 | 553 |

As shown in Table 1, tobacco stem particles can effectively increase the bulkiness of the reconstituted tobacco. Specially, tobacco stem particles A (i.e., tobacco stem particles of large particle size) can increase the bulkiness by 8%. Tobacco stem particles B can increase the bulkiness and air permeability of the reconstituted tobacco. Tobacco stem particles A and B can improve the softness of the reconstituted tobacco.

Example 5

(1) Tobacco stems were grinded to tobacco stem particles using a pulverizer. The tobacco stem particles were passed through mesh sieves of 60, 80, 120, and 200 meshes to obtain tobacco stem particles A, tobacco stem particles B, tobacco stem particles C, and tobacco stem particles D.

(2) Additional tobacco stems were extracted with water and grinded to obtain a tobacco stem slurry with a beating degree of 14° SR. The tobacco stem slurry and tobacco leaves were mixed in a weight ratio of 6:4 and grinded to form a tobacco slurry with a beating degree of 18° SR.

(3) The Canadian Prince George brand bleached hardwood pulp boards were cut and dispersed in water by a disintegrator to form a plant fiber pulp.

(4) Calcium carbonate filler with partial triangular shape and a particle size of 8-10 μm was dissolved in water to form a 10 wt % filler solution.

(5) The tobacco slurry, the plant fiber pulp, and filler were mixed in a dry weight ratio of 1:0.25:0.15. The tobacco stem particles B were added in an amount of 15 wt % of the total dry weight of the tobacco slurry and the plant fiber pulp to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 2.

Example 6

(1) Tobacco stems were grinded to tobacco stem particles using a pulverizer. The tobacco stem particles were passed through mesh sieves of 60, 80, 120, and 200 meshes to obtain tobacco stem particles A, tobacco stem particles B, tobacco stem particles C, and tobacco stem particles D.

(2) Additional tobacco stems were extracted with water and grinded to obtain a tobacco stem slurry with a beating degree of 13° SR. The tobacco stem slurry and tobacco leaves were mixed in a weight ratio of 6:4 and grinded to form a tobacco slurry with a beating degree of 20° SR.

(3) The Chilean Star brand bleached hardwood pulp boards were cut and dispersed in water by a disintegrator to form a plant fiber pulp.

(4) Calcium carbonate filler with partial triangular shape and a particle size of 8-10 μm was dissolved in water to form a 10 wt % filler solution.

(5) The tobacco slurry, the plant fiber pulp, and filler were mixed in a dry weight ratio of 1:0.25:0.15. The tobacco stem particles B were added in an amount of 15 wt % of the total dry weight of the tobacco slurry and the plant fiber pulp to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 2.

Example 7

(1) Tobacco stems were grinded to tobacco stem particles using a pulverizer. The tobacco stem particles were passed through mesh sieves of 60, 80, 120, and 200 meshes to obtain tobacco stem particles A, tobacco stem particles B, tobacco stem particles C, and tobacco stem particles D.

(2) Additional tobacco stems were extracted with water and grinded to obtain a tobacco stem slurry with a beating degree of 14° SR. The tobacco stem slurry and tobacco leaves were mixed in a weight ratio of 6:4 and grinded to form a tobacco slurry with a beating degree of 20° SR.

(3) The Canadian Prince George brand bleached hardwood pulp boards were cut and dispersed in water by a disintegrator to form a plant fiber pulp.

(4) Calcium carbonate filler with partial triangular shape and a particle size of 8-10 μm was dissolved in water to form a 10 wt % filler solution.

(5) The tobacco slurry, the plant fiber pulp, and filler were mixed in a dry weight ratio of 1:0.25:0.15. The tobacco stem particles B were added in an amount of 15 wt % of the total dry weight of the tobacco slurry and the plant fiber pulp to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 2.

Example 8

(1) Tobacco stems were grinded to tobacco stem particles using a pulverizer. The tobacco stem particles were passed through mesh sieves of 60, 80, 120, and 200 meshes to obtain tobacco stem particles A, tobacco stem particles B, tobacco stem particles C, and tobacco stem particles D.

(2) Additional tobacco stems were extracted with water and grinded to obtain a tobacco stem slurry with a beating degree of 13° SR. The tobacco stem slurry and tobacco leaves were mixed in a weight ratio of 6:4 and grinded to form a tobacco slurry with a beating degree of 19° SR.

(3) The Canadian Prince George brand bleached hardwood pulp boards were cut and dispersed in water by a disintegrator to form a plant fiber pulp.

(4) Calcium carbonate filler with partial triangular shape and a particle size of 8-10 μm was dissolved in water to form a 10 wt % filler solution.

(5) The tobacco slurry, the plant fiber pulp, and filler were mixed in a dry weight ratio of 1:0.25:0.15. The tobacco stem particles B were added in an amount of 15 wt % of the total dry weight of the tobacco slurry and the plant fiber pulp to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 2.

Example: Control 2

(1) Tobacco stems were extracted with water and grinded to obtain a tobacco stem slurry with a beating degree of 12° SR. The tobacco stem slurry and tobacco leaves were mixed in a weight ratio of 6:4 and grinded to form a tobacco slurry with a beating degree of 20° SR.

(2) The Canadian Prince George brand bleached hardwood pulp boards were cut and dispersed in water by a disintegrator to form a plant fiber pulp.

(3) Calcium carbonate filler with partial triangular shape and a particle size of 8-10 μm was dissolved in water to form a 10 wt % filler solution.

(4) The tobacco slurry, the plant fiber pulp, and filler were mixed in a dry weight ratio of 1:0.25:0.15 to form a mixed slurry. By using wet forming technology with a basis weight of 60 g/m$^2$, the mixed slurry was pressed and dried to form reconstituted tobacco with increased bulkiness. The physical properties of the reconstituted tobacco are shown in Table 2.

TABLE 2

Example 5-8 Preparation of substrate performance test

| | Control 2 | Example 5 | Example 6 | Example 7 | Example 8 |
|---|---|---|---|---|---|
| Tobacco Stem Particles | n/a | A | B | C | D |
| Bulkiness (cm$^3$/g) | 3.05 | 3.29 | 3.23 | 3.21 | 3.07 |
| Tensile Strength (N) | 5.7 | 4.6 | 4.8 | 5.0 | 5.3 |
| Air Permeability (um/Pa·s) | 65.2 | 75.5 | 88.1 | 82.6 | 74.6 |
| Softness (mN) | 489 | 466 | 473 | 554 | 561 |

As shown in Table 2, tobacco stem particles A, B, and C increase the bulkiness of the reconstituted tobacco; tobacco stem particles A, B, C, and D increase the air permeability of the reconstituted tobacco; and tobacco stem particles C and increase the softness of the reconstituted tobacco.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for increasing bulkiness of reconstituted tobacco by adding tobacco stem particles, comprising the following steps:

(1) pulverizing a first portion of tobacco stems to obtain tobacco stem particles;

(2) classifying the tobacco stem particles with mesh sieves and selecting the tobacco stem particles with a predetermined mesh size;

(3) extracting a second portion of the tobacco stems with water and grinding to form a tobacco stem slurry that has a beating degree of 12-14° SR, and mixing the tobacco stem slurry with tobacco leaves in a weight ratio of 6:4 and grinding to obtaining a tobacco slurry that has a beating degree of 18-20° SR;

(4) cutting plant fiber pulp boards and dispersing in water to form a plant fiber pulp;

(5) preparing a filler solution that contains 10 wt % of a mineral filler; and (6) mixing the tobacco stem particles with the predetermined mesh size, the tobacco slurry, the plant fiber pulp, and the filler solution, rolling and drying to obtain the reconstituted tobacco with increased bulkiness.

2. The method according to claim 1, wherein in step (2), the mesh sieves have mesh sizes of 60, 80, 120, and 200 mesh.

3. The method according to claim 1, wherein in step (2), the tobacco stem particles with the predetermined mesh size include one or more selected from the group consisting of tobacco stem particles A with a particle size of greater than 250 μm, tobacco stem particles B with a particle size of between 180 μm and 250 μm, tobacco stem particles C with a particle size of between 120 μm and 180 μm, and tobacco stem particles D with a particle size of between 75 μm and 120 μm;

the tobacco stem particles B increase the bulkiness and an air permeability of the reconstituted tobacco;

the tobacco stem particles C increase the bulkiness of the reconstituted tobacco;

the tobacco stem particles D increase the bulkiness and a strength of the reconstituted tobacco; and a combination of the tobacco stem particles A and the tobacco stem particles B increases bulkiness and a softness of the reconstituted tobacco.

4. The method according to claim 1, wherein the plant fiber pulp boards are bleached softwood pulp boards, bleached hardwood pulp boards, or natural insulating pulp boards.

5. The method according to claim 1, wherein the mineral filler is a calcium carbonate filler with an average particle size of 4-10 μm or a porous calcium silicate filler with an average particle size of 15-40 μm.

6. The method according to claim 1, wherein a dry weight ratio of the second tobacco slurry, the plant fiber pulp, and the mineral filler is 1:0.25:0.15; and the tobacco stem particles with the predetermined mesh size is about 15 wt % of a total dry weight of the tobacco slurry and the plant fiber pulp.

* * * * *